US007694436B2

(12) United States Patent
Mullen

(10) Patent No.: US 7,694,436 B2
(45) Date of Patent: Apr. 13, 2010

(54) FOOTWEAR REPAIR

(76) Inventor: Scott Mullen, HCR 3 Box 13538, Keaau, HI (US) 96749

( * ) Notice: Subject to any disclaimer, the term of this patent is extended or adjusted under 35 U.S.C. 154(b) by 826 days.

(21) Appl. No.: 11/580,968

(22) Filed: Oct. 13, 2006

(65) Prior Publication Data

US 2008/0086825 A1 Apr. 17, 2008

(51) Int. Cl.
*A43B 3/12* (2006.01)

(52) U.S. Cl. ..... 36/11.5; 12/142 Q

(58) Field of Classification Search ..... 36/11.5, 36/94; 12/142 Q, 142
See application file for complete search history.

(56) References Cited

U.S. PATENT DOCUMENTS

| | | | | |
|---|---|---|---|---|
| 736,194 | A * | 8/1903 | Bassett | 36/11.5 |
| 2,016,070 | A | 10/1935 | Brockman | |
| 2,040,001 | A | 5/1936 | Jones | |
| 2,368,314 | A * | 1/1945 | Marx | 36/11.5 |
| 2,420,187 | A | 5/1947 | Phillips | |
| 2,928,191 | A * | 3/1960 | Meltzer | 36/94 |
| 2,947,095 | A * | 8/1960 | Miyachi | 36/11.5 |
| 3,336,683 | A | 8/1967 | Schellkopf | |
| 3,553,754 | A | 1/1971 | Mendelsohn | |
| 3,748,757 | A * | 7/1973 | Silver | 36/11.5 |
| 3,902,259 | A | 9/1975 | Cracco | |
| 3,928,927 | A | 12/1975 | Brown et at | |
| 3,978,596 | A | 9/1976 | Brown et al. | |
| 4,051,610 | A | 10/1977 | Shigeji | |
| 4,172,330 | A | 10/1979 | Kao | |
| 5,682,690 | A | 11/1997 | Chang | |
| 5,992,058 | A | 11/1999 | Jneid | |
| 6,769,204 | B1 | 8/2004 | Phillips | |
| 6,883,252 | B2 * | 4/2005 | Cagner | 36/11.5 |
| 6,904,706 | B2 | 6/2005 | Jones et al. | |
| 2002/0121030 | A1 | 9/2002 | Coleman | |
| 2005/0016018 | A1 | 1/2005 | Cagner | |
| 2005/0044746 | A1 | 3/2005 | Kelley | |
| 2006/0026862 | A1 * | 2/2006 | Cagner | 36/11.5 |
| 2008/0301977 | A1 * | 12/2008 | Roberts et al. | 36/94 |

FOREIGN PATENT DOCUMENTS

| | | | |
|---|---|---|---|
| FR | 2661074 | A1 * | 10/1991 |
| WO | WO 2005/082192 | | 9/2005 |

* cited by examiner

*Primary Examiner*—Marie Patterson
(74) *Attorney, Agent, or Firm*—Robert M. Hunter; Micheal McKenna

(57) ABSTRACT

An improved grommet assembly for repairing a sandal having a foot retainer attached to a sole at least one terminus of the foot retainer includes a flange having a cross-sectional width substantially greater than a cross-sectional width of the at least one terminus. A bore extends axially through the flange, defining an opening of sufficient size to accommodate insertion of the terminus therethrough. A securing mechanism adapted and constructed to secure the grommet to the at least one terminus. The flange can be used in association with a sandal repair kit.

18 Claims, 7 Drawing Sheets

FOOTWEAR REPAIR

CROSS-REFERENCE TO RELATED APPLICATIONS

None

STATEMENT AS TO RIGHTS TO INVENTIONS MADE UNDER FEDERALLY-SPONSORED RESEARCH AND DEVELOPMENT

None

FIELD OF THE INVENTION

The invention relates generally to footwear repair, and specifically to various mechanisms and methods for repairing sandals.

DESCRIPTION OF RELATED ART

According to Cameron Kippen of the Curtin University of Technology in Perth, Western Australia, scientists estimate people first wore animal skins during the Ice Age (5,000,000 years ago), and that Stone Age peoples employed rough shoes to protect their feet. The first suggestion of foot coverings appeared in rock paintings from the late Paleolithic period (15,000 years ago). Spanish cave paintings show humans with animal skins around their feet. A major disadvantage of these early types of footwear was that animal skins decayed and rotted away in a relatively short time.

Sandals are believed to be the first crafted foot coverings and successors to primitive wrappings. The designs were both simple and practical. Straps or thongs attached the stiff sole to the foot for protection. Two basic designs prevailed. One involved thongs fitted between the toes, and the other more sophisticated had loops and holes along the edge of the soles for attaching thongs to the foot. Soles were made from almost anything that was available including leaves and wood. In Ancient Egypt sandals were made from papyrus and palm leaves; rawhide was used by the Masai in Africa. Wooden sandals were made in India and rice straw was used in China and Japan. The leaves of the sisal plant provided twine for sandals in South America whereas the indigenous populations of Mexico used the yucca plant. The oldest surviving examples of papyrus sandals are exhibited in the British Museum and dated at 1,500 BC. The thong or toe strap became distinctive in sandal design. Subsequent civilizations preferred different toes, the Greeks for example made use of the great toe; the Romans, the second digit; and the Mesapotanians, the third toe. These distinctive, physical entities were also recognized and captured in Egyptian statues, and this was thought to represent celebration of other cultures.

Sandals remain popular today, yet their design has changed little from antiquity. Perhaps the most ubiquitous sandal design worn today is the slipper-style sandal known as the thong or flip-flop. Inexpensive as they are comfortable, flip-flops are a kind of flat, backless sandal having a flat sole held on the foot by a V-shaped foot retainer that passes between the great toe and second toe, and around either side of the foot. The foot retainer is attached to the sole at three points of terminus, and is commonly known as a thong strap. They appear to have been developed out of traditional Japanese woven or wooden soled sandals (i.e., zori and setta) in New Zealand. The flip-flop is typically constructed with a foam-rubber sole, with the thong strap being fabricated from synthetic webbing or rubber.

Sandals of various construction are known, and are well represented in the patent literature. One example is U.S. Pat. No. 4,172,330 to Kao, in which a sandal with removable straps includes a platform having a top surface, a bottom surface and a side surface extending around the platform. The platform includes a plurality of openings, each extending from the top surface to the bottom or side surface. A plurality of recesses, complementary in number to the plurality of openings, with each recess surround the end of each opening in the bottom or side surface. A removable strap member has loop portions at the ends of the strap member. The ends of the strap extend through the openings from the top surface. The loop portions lay within the recesses. A plurality of button members complementary in number to the plurality of recesses include means for locking the loop portions within the recesses. Each button member has a size and shape to substantially fill its recess.

In another example, U.S. Pat. No. 6,904,706 to Jones is directed to footwear, in the category of a sandal, which may include a thong, slide-on, clog, or related structured sandal. One side or the other of a tongue, upper vamp, or sandal strap may be adhered to an upper part of the sandal sole, or its vamp or cross strap, so that one side of the sandal strap structure may be displayed during its wearing, and can be turned to expose its opposite surface for varying the styling of the worn sandal. The tongue, upper vamp, or strap may be secured by a fastening device, such as a swivel, that allows for turning of these components to expose a selected surface in order to vary the aesthetics and appearance of the worn sandal.

U.S. Patent Publication No. US 2005/0016018 A1 to Cagner shows a shoe including an outsole, an insole, an upper, and a reinforcement member. The insole is attached to the outsole along an upper surface thereof and is provided with at least one aperture extending through the insole to the upper surface of the outsole. The upper includes an elongate element extending into the aperture. The reinforcement member is attached to the insole at least along an upper side of the aperture for protecting material of the insole from stresses arising from movement of the elongate element of the upper.

In U.S. Patent Publication No. US 2002/0121030 A1 to Coleman, a cylindrically-shaped cushion for attachment around the straps of footwear having straps 16 thereon which cushion is designed to be worn between the big toe and the pointer toe of a user. The cylindrically shaped cushion has an inner fabric and an outer fabric design which can be made in many different designs and colors. The cushion also has a split running vertically therethrough which allows the cushion to be opened at so that it can be placed around the straps 16 of the footwear. Located on one side of the split is a vertical adhesive strip having a peel-off strip which will adhesively seal to the opposing vertical face of the non-adhesive side. Also disposed on the inner bore of the cushion is a horizontal adhesive strip having a peel-off strip thereon which is used for attachment to the strap.

Although these known forms of footwear provide some advantages, they present significant drawbacks as well. For example, the various straps making up the foot retainer are often subject to premature wear or accidental breakage. It is also common for the sole portion to suffer damage or wear in a particular area. Perhaps the most frequent area of concern occurs when one or more of the termini of the thong strap pull through the sole. If any of these instances, the sandal is usually considered by the user to be ruined, and the sandal is discarded. Despite the fact that some sandals can be purchased at relatively low cost, frequent and repeated replacement of even inexpensive sandals can be costly in the long term.

It can be seen the foregoing that the need exists for a simple, inexpensive arrangement and method for repairing footwear.

SUMMARY

In accordance with the principles of the present invention, an improved grommet assembly for repairing a sandal having a foot retainer attached to a sole at least one terminus of the foot retainer includes a flange having a cross-sectional width substantially greater than a cross-sectional width of the at least one terminus. A bore extends axially through the flange, defining an opening of sufficient size to accommodate insertion of the terminus therethrough. A securing mechanism adapted and constructed to secure the grommet to the at least one terminus. The flange can be used in association with a sandal repair kit.

The invention itself, however, both as to organization and method of operation, together with further objects and advantages thereof, may be best understood by reference to the following description taken in conjunction with the accompanying drawings.

DETAILED DESCRIPTION OF PREFERRED EMBODIMENTS

Figure 1:
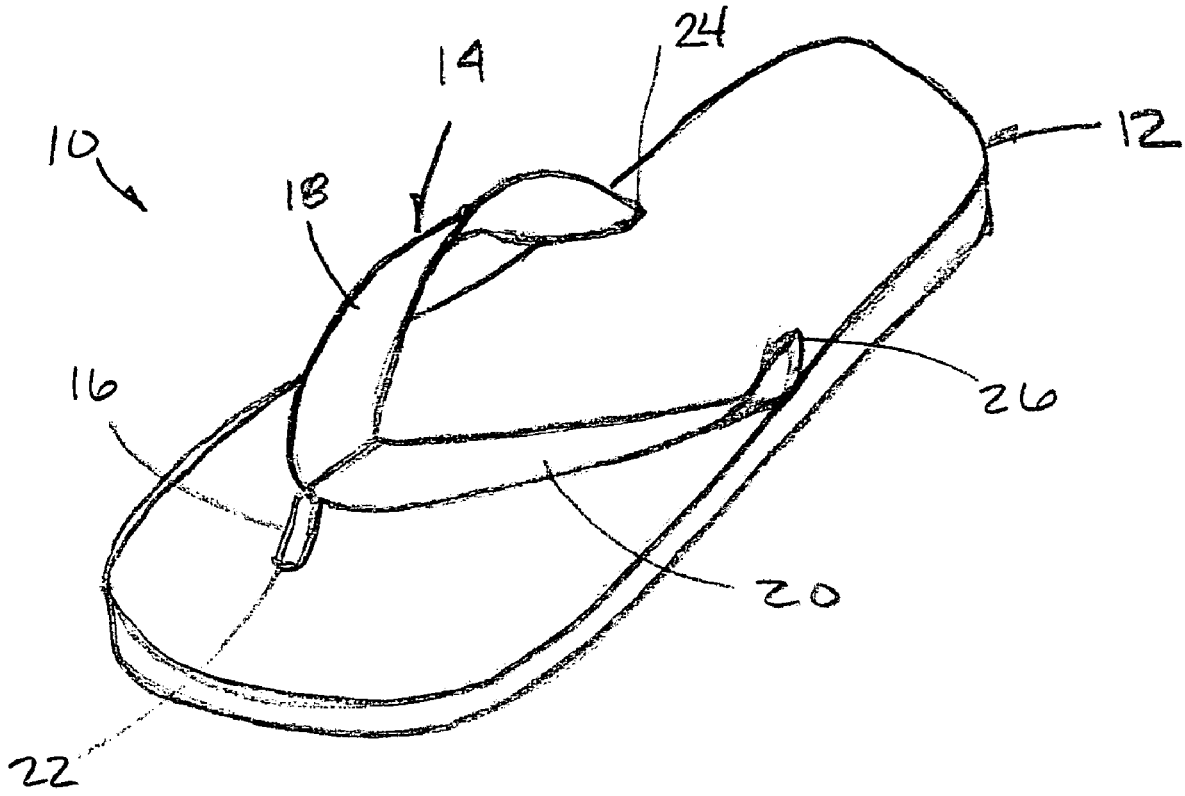
FIG. 1 illustrates a perspective view of a sandal of known construction.

While this invention is susceptible of embodiment in many different forms, there is shown in the drawings, and will herein be described in detail, exemplary embodiments, with the understanding that the present disclosure is to be considered as illustrative of the principles of the invention and not intended to limit the invention to the exemplary embodiments shown and described.

Figure 2:
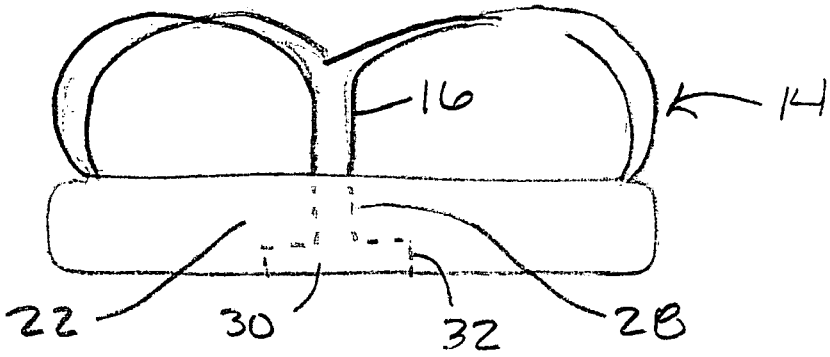
FIG. 2 illustrates a front elevational view the FIG. 1 sandal.

FIGS. 1 and 2 illustrate a sandal 10 of known construction. The sandal 10 includes a sole portion 12 and a foot retainer 14. The foot retainer 14 as shown is provided in the form of a Y-shaped thong strap, in which a toe element 16 forms the leg of the Y and extends downwardly between the great toe and second toe of a wearer. First and second foot straps 18, 20 extend angularly outwardly to form the arms of the Y of the thong strap. The toe element 16 and the foot straps 18, 20 are attached to the sole 12 at respective termini 22, 24, 26.

FIG. 2 shows the attachment between the termini 22, 24, 26 and the sole 12 in greater detail. The toe element 16 extends through an aperture 28 in the sole 12, and terminates in a retaining disc 30 within a recess 32 in the sole 12. the retaining disc prevents the toe element 16 from being pulled through the sole 12. The termini 24, 26 are constructed in a similar fashion.

Figure 3:
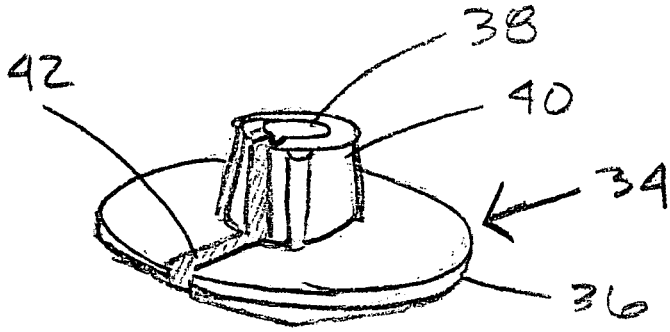
FIG. 3 illustrates a perspective view of an improved grommet in accordance with the principles of the present invention.

Unfortunately, the termini 22, 24, 26 are subject to a high degree of stress during use of the sandal, and are thus prone to breakage. As shown in FIG. 3, it is not uncommon for the shaft of the termini, here the terminus 22 of the toe element 16, to become separated from the retaining disc 30. When this occurs, the toe element 16 pulls through the sole 12, rendering the sandal unwearable.

Figure 4:
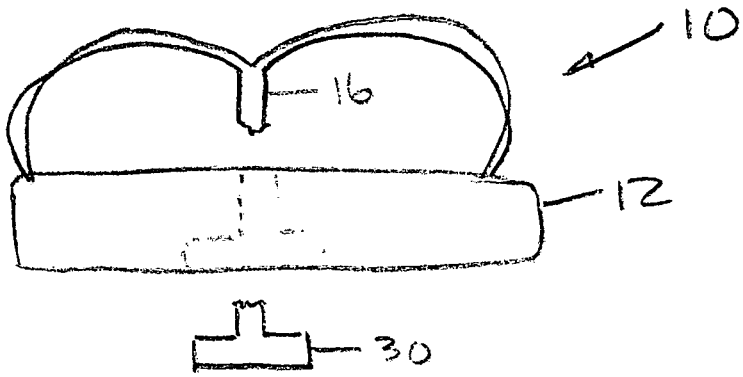
FIG. 4 illustrates a front elevational view of a broken sandal.

The breakage illustrated in FIG. 3 can be repaired employing an improved grommet 34 as shown in FIG. 4. The grommet 34 includes a flange having a cross-sectional width substantially greater than a cross-sectional width of the terminus 22. It may also provide particular advantage if the flange width is chosen to be greater than the width of the recess 32, in the event that the disc itself is pulled through the sole 12, enlarging the aperture 28. It is contemplated that the flange 36 should be provided with a width in the range of approximately ½ inch to 1½ inches. It has been found that a width of approximately 1 inch provides particular advantage.

The grommet 34 is provided with a bore 38 extending axially through the flange 36. The bore 34 defines an opening of sufficient size to accommodate insertion of the terminus 22 therethrough.

A collar 40 can be provided to extend centrally from the flange 36, wherein the bore 38 passes through the flange 36 and the collar 40. The collar 40 is sized to extend into the aperture 28 of the sole 12 approximately ½ inch from the flange 36. The grommet 40 can be provided with a radial slot 42 extending through flange 36 and the collar 40. The slot 42 facilitates insertion of the shaft 116 into the grommet 34.

Figure 5:
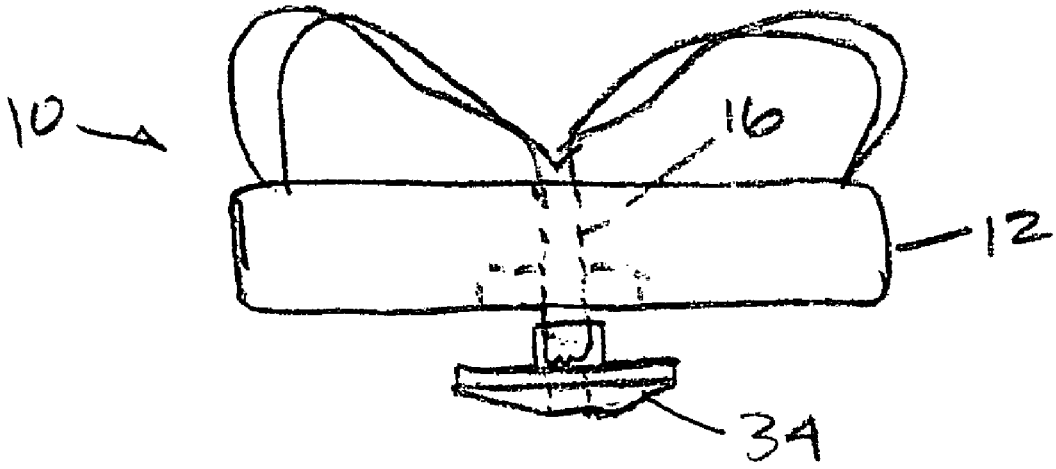
FIG. 5 illustrates a front elevational view of a grommet in place on the broken sandal of FIG. 4.

As shown in FIG. 5, the sandal 10 is repaired by extending the shaft 16 of the terminus 22 through the sole 12. The shaft 16 of the terminus 22 is then placed through the bore of the grommet 34, and the shaft is secured to the grommet using a suitable securing mechanism. It is contemplated that the grommet can be secured to the shaft using an adhesive. One adhesive found to be particularly effective is FIX-ALL SUPER GLUE, marketed by Wal-Mart. It is also contemplated that the can be pinned to the grommet using a suitable sharp pin element.

Figure 6:
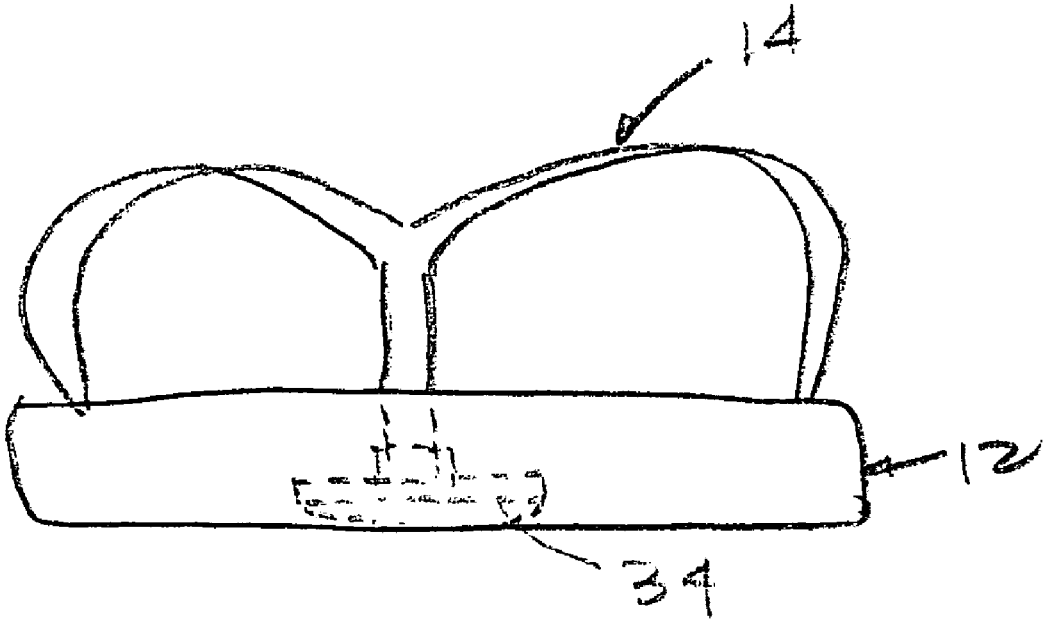
FIG. 6 illustrates the FIG. 4 sandal in a repaired condition.

With grommet 34 secured to the shaft 16, the terminus 22 can be replaced in the sole 12, and the sandal is repaired and ready for further use, as shown in FIG. 6.

Figure 7:
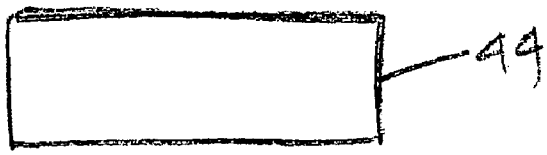
FIG. 7 illustrates a strap repair strip.

Various other sandal components can be repaired using a variety of additional mechanisms. For example, FIG. 7 illustrates a strap repair strip 44 used for repairing the straps of the sandal 10. The strap repair strip 44 is provided with dimensions adapted to the dimensions commonly used in sandal straps. It has been found that a dimension of approximately 2 inches×1 inch provides particular utility.

Figure 8:
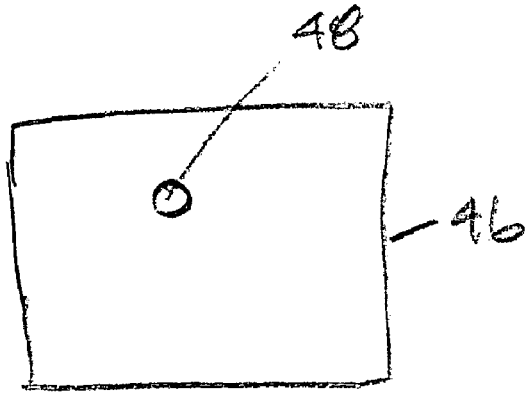
FIG. 8 illustrates a sole repair patch.

FIG. 8 illustrates a sole repair patch 46 used to repair worn or damages areas of the sole 12 of the sandal 10. The sole repair patch is adapted to secure, cover, or connect parts of the sole, typically at the ball or heel of the sole, The sole repair patch 46 can be provided with an aperture 48 of a size to accommodate insertion of the collar 40 of the grommet 34. In this manner, the sole patch 46 can be used when the portion of the sole 12 at or near the aperture 28 is enlarged or damaged, in effect constructing a partial replacement sole. The sole repair patch 46 can be advantageously provided with a dimension of approximately 3 inches×2 inches.

Figure 9:
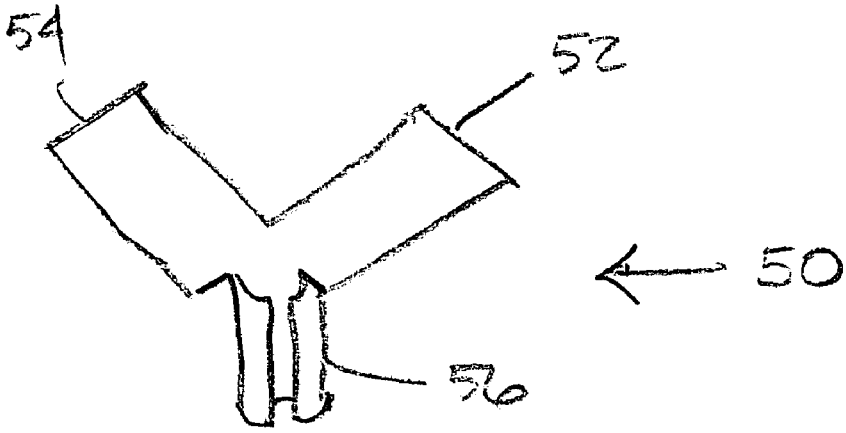
FIG. 9 illustrates a junction repair Y-strip.

FIG. 9 illustrates a junction repair Y-strip 50. The junction repair Y-strip 50 includes a pair of strap repair portions 52, 54 extending angularly from a tubular shaft repair portion 56. The Y-strip 50 may be provided in a flat rectangular patch that can be cut along indicia or severed along perforations to form the contour of the Y-strip 50 as shown in FIG. 9. The strap repair portions 53, 54 are intended to be secured to the strap portions immediately adjacent to the toe element, while the tubular repair portion 56 is adapted to surround the toe element itself. Each of the repair portions 52, 54, 56 can have a length of approximately 2 inches. The strap repair strip 44, sole repair patch 46, and junction repair Y-strip 50 can all be fabricated from a suitable material providing flexibility and durability. It has been found that rubber, particularly rubber of the type used in manufacturing inner tubes, provides particular advantage.

Figure 10:
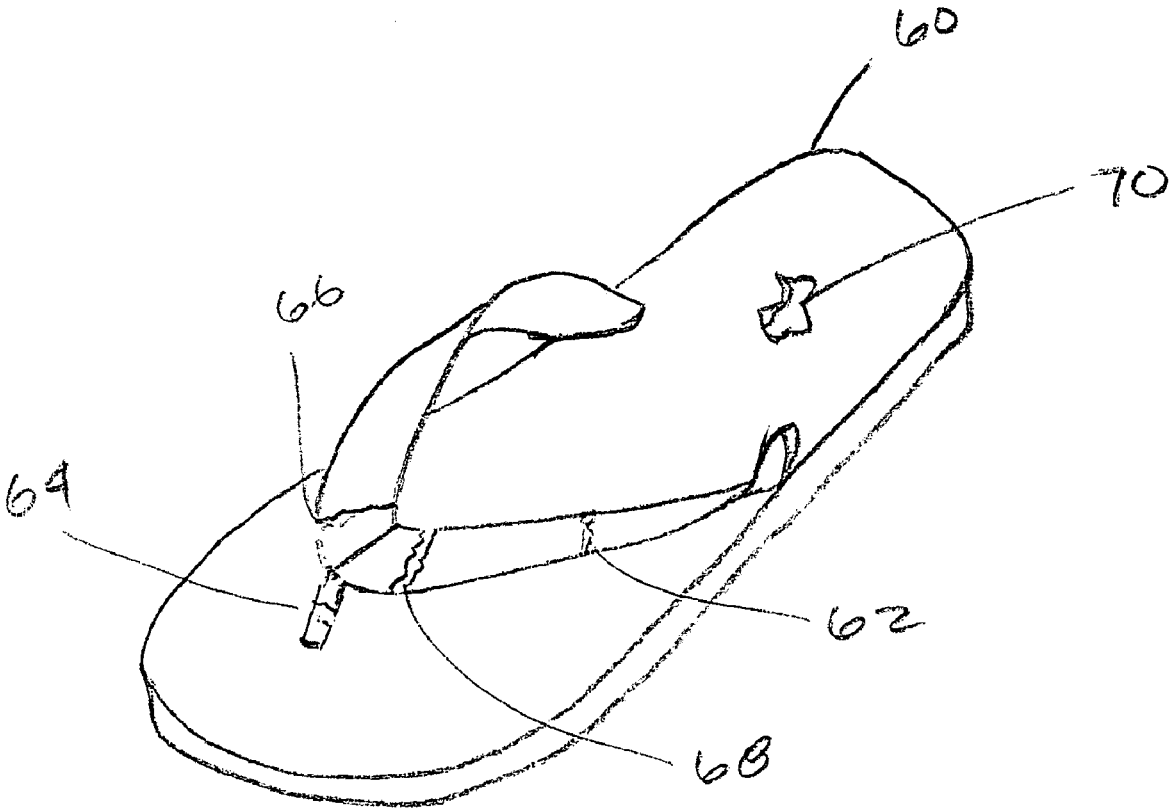
FIG. 10 illustrates a top plan view of a sandal having broken straps.
Figure 11:
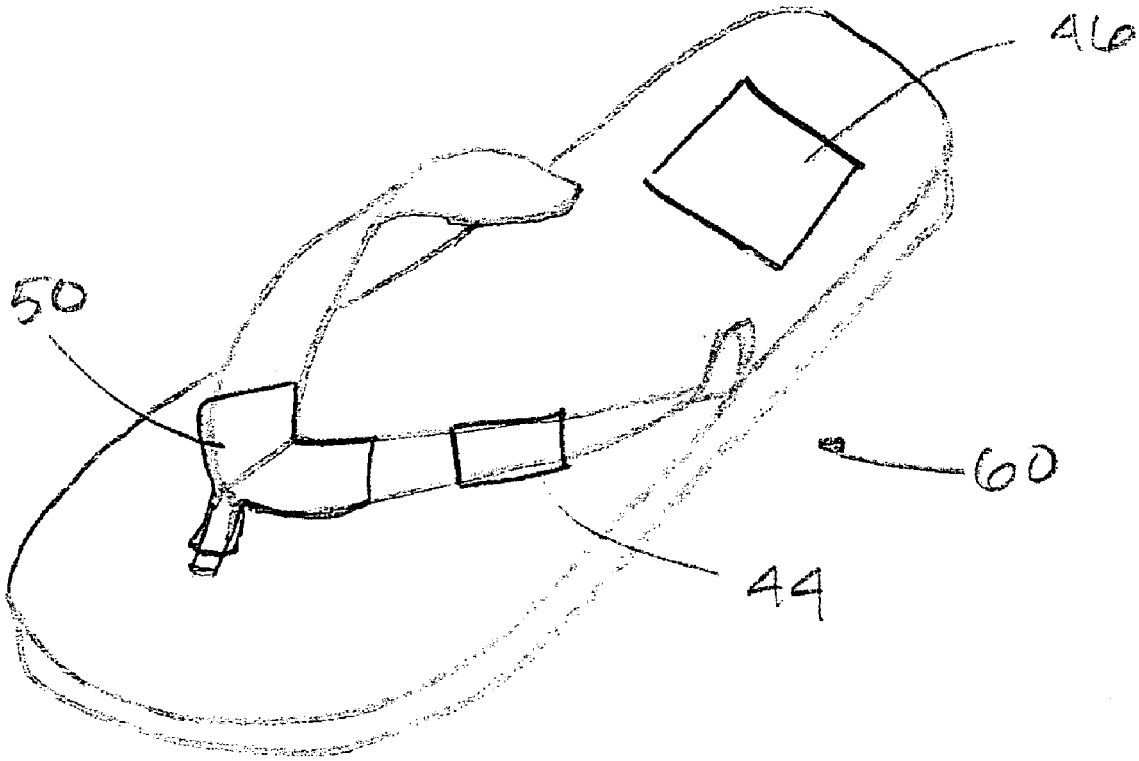
FIG. 11 illustrates a top plan view of the FIG. 10 sandal in a repaired condition.

FIG. 10 illustrates a top plan view of a sandal 60 having broken straps. The breaks are shown at the joint of the thong strap 64, 66, 68, on one of the foot straps 62, and on the sole 70. As shown in FIG. 11, the sandal 60 is repaired by securing the a junction repair Y-strip 50 to the Y-joint, the strap repair strip 44 to the strap, and the sole patch 46 to the sole. The repair element can be secured in a manner similar to that used in securing the grommet as previously described, as with an adhesive.

Figure 12:
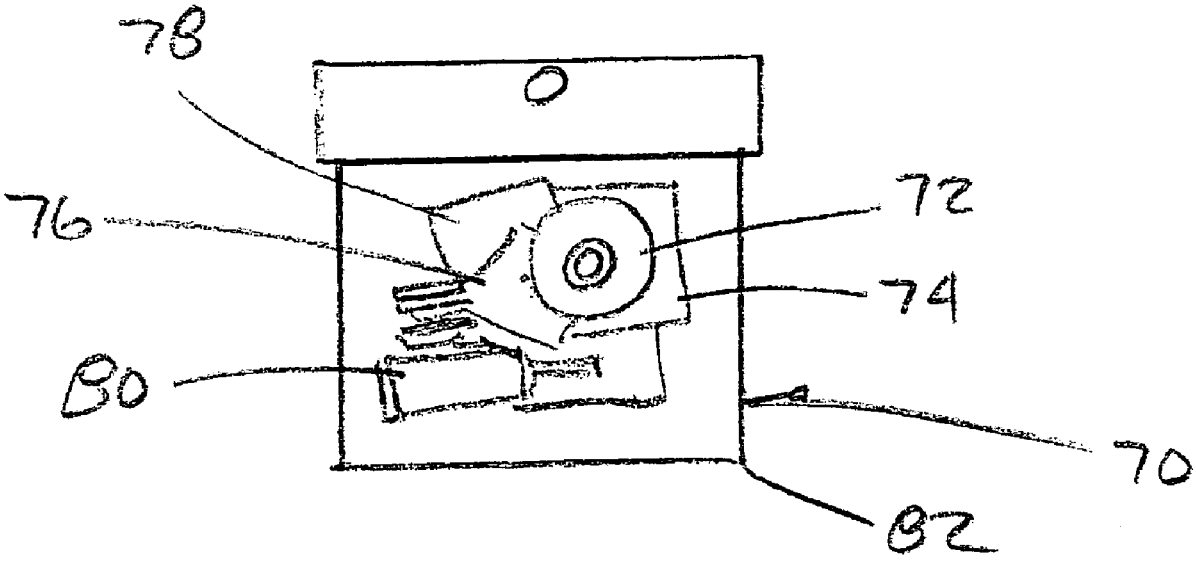
FIG. 12 illustrates a schematic perspective view of a footwear repair kit in accordance with the principles of the present invention.

FIG. 12 illustrates a footwear repair kit 70 in accordance with the principles of the present invention. The kit 70 includes at least one repair grommet 72, at least one strap repair strip 74, at least one sole repair patch 76, at least one junction repair Y-strip 78, and at least one securing mechanism, here shown as a tube of adhesive 80. Alternatively, each of the patches of the repair kit can be provided with self-adhesive and a backing, in which case the tube of adhesive may not be required. All of these components are secured within a container 82. The kit 70 provides a sandal user with an inexpensive, convenient and easily-transported assembly of components to remedy the most common structural failures of sandals. This saves the sandal owner the inconvenience and expense of having to replace sandals in the event of breakage.

The kit for repairing a sandal having a sole and a generally Y-shaped foot retainer strap that passes between the great toe and second toe, and around either side of the foot of a wearer, the foot retainer being attached to the sole at three termini, the kit may also comprise a grommet including a flange having a cross-sectional width substantially greater than a cross-sectional width of the respective termini and a bore extending axially through the flange, the bore defining an opening of sufficient size to accommodate insertion of the respective termini therethrough; at least one repair grommet; at least one sole repair patch; and at least one securing mechanism adapted and constructed to secure the respective components of the kit to corresponding portions of the sandal to be repaired. The at least one securing mechanism may comprise one of an applied adhesive and a self-adhesive that is part of the patch.

It can be seen from the foregoing that the present invention provides advantages in a wide range of applications. While details of the invention are discussed herein with reference to some specific examples to which the principles of the present invention can be applied, the applicability of the invention to other devices and equivalent components thereof will become readily apparent to those of skill in the art. Accordingly, it is intended that all such alternatives, modifications, permutations, and variations to the exemplary embodiments can be made without departing from the scope and spirit of the present invention.

What is claimed is:

1. An improved grommet assembly for repairing a sandal having a foot retainer attached to a sole by at least one terminus of the foot retainer, the grommet comprising the following:

a flange having a cross-sectional width substantially greater than a cross-sectional width of the at least one terminus;

a bore extending axially through the flange, the bore defining an opening of sufficient size to accommodate insertion of the terminus therethrough;

a collar extending centrally from the flange, wherein the bore passes through the flange and the collar;

a radial slot extending trough the flange and the collar to the bore; and a securing mechanism adapted and constructed to secure the grommet to the at least one terminus.

2. An improved grommet assembly in accordance with claim 1, wherein the flange comprises a generally circular flange having a diameter substantially greater than a cross-sectional width of the at least one terminus.

3. An improved grommet assembly in accordance with claim 2, wherein the flange has a diameter in a range of approximately 0.75 inches to 1.25 inches.

4. An improved grommet assembly in accordance with claim 2, wherein the flange has a diameter of approximately 1 inch.

5. An improved grommet assembly in accordance with claim 1, wherein the collar extends approximately ½ inch from the flange.

6. A kit for repairing a sandal having a sole and a generally Y-shaped foot retainer strap that passes between the great toe and second toe, and around either side of the foot of a wearer, the foot retainer being attached to the sole at three termini, the kit comprising the following:

a grommet including a flange having a cross-sectional width substantially greater than a cross-sectional width of the respective termini and a bore extending axially through the flange, the bore defining an opening of sufficient size to accommodate insertion of the respective termini therethrough;

at least one repair grommet;

at least one strap repair strip;

at least one sole repair patch;

at least one junction repair Y-strip; and at least one securing mechanism adapted and constructed to secure the respective components of the kit to corresponding portions of the sandal to be repaired.

7. A kit in accordance with claim 6, wherein the flange further comprises a collar extending centrally from the flange, wherein the bore passes through the flange and the collar.

8. A kit in accordance with claim 7, further comprising a radial slot extending through the flange and the collar to the bore.

9. A kit in accordance with claim 6, wherein the strap repair strip is fabricated from rubber.

10. A kit in accordance with claim 6, wherein the sole repair patch is fabricated from rubber.

11. A kit in accordance with claim 6, wherein the junction repair Y-strip comprises the following:

a pair of flat strap strips forming angular arms of the Y-strip; and a repair tube forming the leg of the Y-strip.

12. A kit in accordance with claim 6, wherein at least one securing mechanism comprises adhesive.

13. A kit in accordance with claim 6, wherein the junction repair Y-strip comprises the following:

a rectangular patch having indicia on at least one side for identifying portions of the patch that can be cut away to form a pair of flat strap strips forming angular arms of the Y-strip and a repair tube forming the leg of the Y-strip.

14. A kit in accordance with claim 6, wherein the junction repair Y-strip comprises the following:

a rectangular patch having perforations though said patch along which a user can identifying identify portions of the patch that can be removed to form a pair of flat strap strips forming angular arms of the Y-strip and a repair tube forming the leg of the Y-strip.

15. A method for repairing a sandal having a foot retainer attached to a sole by at least one terminus of the foot retainer, the terminus having a generally elongate shaft portion adapted and constructed to extend through the sole, the method comprising the following steps:

providing a grommet including a flange having a cross-sectional width substantially greater than a cross-sectional width of the shaft of the terminus, a collar extending centrally from the flange, a bore extending axially though the flange and the collar the bore defining an opening of sufficient size to accommodate insertion of the shaft therethrough;

extending the shaft of the terminus through the sole;

placing the shaft of the terminus though the bore of the grommet; and securing the shaft to the grommet.

16. A method in accordance with claim 15, wherein the step of securing the shaft to the grommet comprises securing the shaft to the grommet using an adhesive.

17. A method in accordance with claim 15, wherein the step of securing the shaft to the grommet comprises pinning the shaft to the grommet.

18. A kit for repairing a sandal having a sole and a generally Y-shaped foot retainer strap that passes between the great toe and second toe, and around either side of the foot of a wearer, the foot retainer being attached to the sole at three termini, the kit comprising the following:

a grommet including a flange having a cross-sectional width substantially greater than a cross-sectional width of the respective termini and a bore extending axially through the flange, the bore defining an opening of sufficient size to accommodate insertion of the respective termini therethrough;

at least one repair grommet;

at least one sole repair patch; and at least one securing mechanism adapted and constructed to secure the respective components of the kit to corresponding portions of the sandal to be repaired.

* * * * *